United States Patent [19]

Millward

[11] 4,427,846

[45] Jan. 24, 1984

[54] MOVING COIL LOUDSPEAKERS

[75] Inventor: Gareth P. Millward, Alwoodley, England

[73] Assignee: Wharfedale Limited, Bradford, United Kingdom

[21] Appl. No.: 236,565

[22] Filed: Feb. 20, 1981

[30] Foreign Application Priority Data

Feb. 21, 1980 [GB] United Kingdom ..... 8005946

[51] Int. Cl.[3] ..... H04R 7/12; H04R 9/02; H04R 9/06

[52] U.S. Cl. ..... 179/115.5 VC; 179/181 R; 181/167; 428/323; 524/427; 524/451; 524/584

[58] Field of Search ..... 181/167, 180; 179/181 R, 115.5 VC; 428/323, 324, 331, 338; 524/427, 451, 584

[56] References Cited

U.S. PATENT DOCUMENTS

| | | | |
|---|---|---|---|
| 3,457,216 | 7/1969 | Dew | 524/451 |
| 3,578,104 | 5/1971 | Sotome | 181/167 X |
| 4,190,746 | 2/1980 | Harwood et al. | 181/167 X |

*Primary Examiner*—Benjamin R. Fuller
*Attorney, Agent, or Firm*—Brisebois & Kruger

[57] ABSTRACT

A moving coil loudspeaker having a cone (14) made of homopolymeric polypropylene which is stiffened by the incorporation of from 20% to 40% mineral filler such as talc or chalk, possibly also up to 5% carbon black filler, and preferably is additionally rigidified at the cone center by a stiffening ring (21) of nylon or like hard plastics material. A further feature of the invention resides in the provision of a metal former (22) carrying lapping paper (25) at the joint with the cone.

10 Claims, 2 Drawing Figures

MOVING COIL LOUDSPEAKERS

FIELD OF THE INVENTION

This invention relates to a moving coil loudspeaker.

BACKGROUND TO THE DISCLOSURE

In a conventional moving coil loudspeaker, the voice coil is carried by a diaphragm or cone which is resiliently suspended at its centre and at its edge from a fixed frame or chassis. In order to achieve accurate response, it is necessary for the diaphragm faithfully to follow the movements of the voice coil, and the mass and rigidity of the cone are important factors in the avoidance of distortion.

PRIOR ART

Recently, in an endeavour to provide improved internal damping which reduces unwanted resonances or "break-ups" which have been observed by holographic techniques, it has been proposed to make the diaphragm or cone of polypropylene copolymer, or in a sandwich construction of polypropylene copolymer with another plastics material or with metal.

One example of a diaphragm or cone which can be made of polypropylene is given in U.K. Specification No. 1563511. This specification also mentions the possibility of a laminated structure in which the plastics material has a ceramic or metallic coating. The aim is to provide a diaphragm or cone made of a material with mechanical Q in the range 7 to 12, Young's modulus in the range $8.5\times10^5$ to $17.5\times10^5$ KN/M$^2$ and density in the range 0.85 to 1.05 gm/cc.

OBJECT OF THE INVENTION

It is an object of the present invention to provide a moving coil loudspeaker having a still further improved construction of diaphragm or cone.

BRIEF SUMMARY OF THE INVENTION

In accordance with the invention, the cone is made of homopolymeric polypropylene incorporating between 20% and 40% by weight of a mineral filler.

The mineral filler adds stiffness to the cone of homopolymeric polypropylene whereby, in a manner analogous to the addition of carbon fibres in paper cones, break-ups are further reduced compared to the known loudspeaker cones comprising or including polypropylene copolymer and, in addition, improved response in the treble frequency region is achieved. An added advantage arising from the use of polypropylene homopolymer rather than a copolymer is improved uniformity and reproducibility of the cone material, while a further advantage of the filler is that the surface energy of the cone is increased, thereby increasing the effectiveness of adhesives used to secure the cone to other parts, such as the cone suspensions and the voice coil.

In contrast with the plastics, e.g. polypropylene, cone known from U.K. Specification No. 1563511, the material of the diaphragm or cone of this invention has a mechanical Q in the overlapping range 7 to 15, but Young's modulus in the distinct non-overlapping range $28\times10^5$ to $57\times10^5$ KN/M$^2$ and density in the distinct non-overlapping range 1.05 to 1.45 gm/cc. These differences are related to the increased stiffness of the cone of this invention as compared with that disclosed in the aforesaid U.K. specification. It should also be mentioned that the preferred diaphragm or cone of this invention is of parabolic section, as distinct from the cone of hyperbolic section proposed in the U.K. specification.

A suitable mineral filler is talc; chalk may alternatively be employed. In general, it has been found that a chalk filler gives the most satisfactory and reproducible results. In either case, up to 5% by weight of carbon black may be incorporated as an additional filler.

FURTHER FEATURES OF THE INVENTION

Especially when in use the cone may be required to operate under conditions of high load, the centre of the cone may be additionally rigidified by the provision of a stiffening ring of nylon or other high melting temperature hard plastics material. In this connection, it is to be noted that the polypropylene homopolymer material with filler is not fully isotropic. The stiffening ring thus provides the additional stiffening desirable to maintain roundness of the coil at high operating temperatures. In addition, the stiffening ring increases the strength of the adhesive bond between the cone and the coil by increasing rigidity in that region, thereby minimising deformation of the adhesive bond when the cone is vibrating.

The loudspeaker in accordance with the invention may include a dust dome at the centre of the cone, and this dust dome may conveniently be made of a flexible material such as polyvinylchloride. This has the advantage of reducing radiation at the coil area, producing a smooth roll off characteristic in the treble region.

A conventional paper or fibreglass or aluminium voice coil former may be used in the loudspeaker of the invention, but there is a potential disadvantage in the case of a metal coil former in that heat is conducted to the top of the former where it is joined to the neck at the centre of the cone, so that a high temperature adhesive must be used to avoid risk of separation at high operating powers. The stiffening ring partly overcomes this disadvantage by providing rigidity, especially if the material and dimensions of the stiffening ring are selected so that, at high temperatures, the diameter of the cone neck is slightly less than the stiffening ring, whereby the cone neck remains rigid due to the maintained tension.

Preferably, however, in the loudspeaker of the invention, the voice coil may be wound on an apertured aluminium former carrying a lapping paper such as that known by the Trade Mark NOMEX. The lapping paper may or may not cover parts of the apertures in the former and, in accordance with another aspect of the present invention, the lapping paper is not overlapped in the direction of the periphery of the former. The lapping paper interposes a barrier between the top of the voice coil former and the cone, thus reducing the temperature at the cone/coil joint. This enables the power handling capability of the speaker to be materially improved; a higher input power (up to 60%) can be tolerated.

DESCRIPTION OF EMBODIMENT

Figure 1:
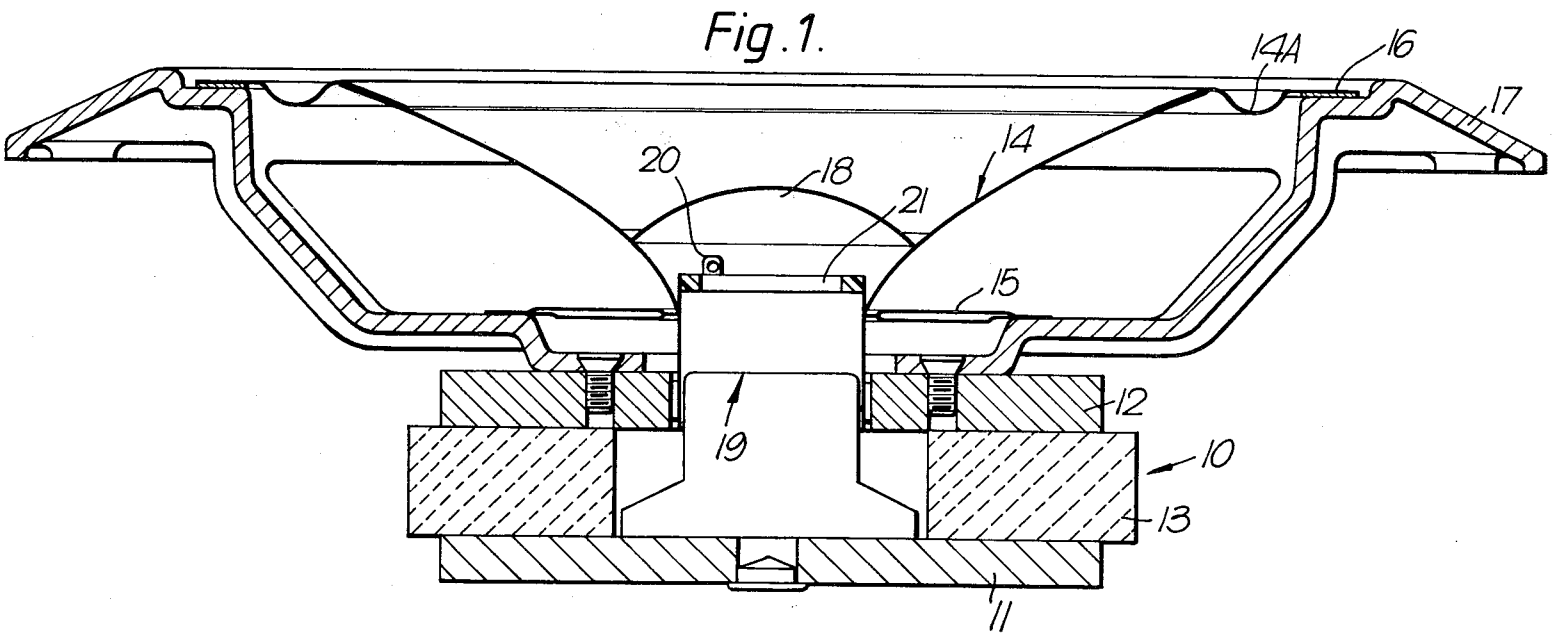
FIG. 1 is an axial section through the loudspeaker.

The loudspeaker shown in FIG. 1 is basically of conventional construction, and need not be described in detail. In the drawing, reference 10 generally denotes a permanent magnet assembly having bottom plate 11, top plate 12 and ceramic spacer 13, while reference 14 denotes a diaphragm or cone resiliently mounted by suspension means 15 at its centre and suspension means 16 at its surround 14A to a frame or chassis 17. The cone 14 has a parabolic section. A dust dome 18 is provided at the centre of the cone 14, covering the voice coil assembly 19. The reference 20 denotes an eyelet for the connection of a lead out conductor.

In accordance with the present invention, the cone 14 is made of homopolymeric polypropylene incorporating about 40% by weight chalk filler. In fact, the amount of chalk filler employed may be selected to suit requirements between 20% and 40% by weight, and talc or another suitable mineral filler may be employed instead. In addition, up to 5% by weight of carbon black may be incorporated as an additional filler. The cone 14 made of such material is lightweight and rigid, and gives accurate response under normal operating conditions.

A suitable filled homopolymeric polypropylene material is made by Doeflex Industries, Redhill, Surrey, England. This material has a mechanical Q in the range 7 to 15, Young's modulus in the range $28\times10^5$ to $57\times10^5$ KN/M$^2$, in particular $32\times10^5$ KN/M$^2$, and density in the range 1.05 to 1.45 gm/cc, in particular 1.25 gm/cc. In general, in the homopolymeric polypropylene material of the cone of this invention, any filler may be incorporated which results in physical properties within these stated ranges.

However, to further stiffen the cone under high operating load conditions, the centre of the cone is rigidified by a stiffening ring 21 of nylon or other suitable high melting point hard plastics material.

In conjunction with the above-described construction of cone 14, the dust dome 18 is made of polyvinylchloride or other suitable flexible material.

Figure 2:
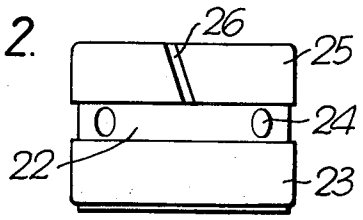
FIG. 2 is a diagrammatic view of the voice coil assembly.

FIG. 2 shows the voice coil assembly 19. This has an aluminium former 22 on which is wound the coil 23, the former having apertures 24 (to improve air flow around the coil and to equalise pressure between the interior and exterior thereof) and carrying lapping paper 25, conveniently that known under the Trade Mark NOMEX. As illustrated, the apertures 24 in the former 22 are not covered by the lapping paper 25, but they can be partly covered if desired. It is, however, important to note that the lapping paper 25 is not overlapped in the direction of the periphery of the former 22. A minimal gap 26 is left between adjacent ends of the paper on the opposite side from the gap between adjacent edges of the coil former material, said gap being slanted at an angle of 15 to 30 degrees to the axis and being as small as possible allowing for manufacturing tolerances, e.g. less than 2 mm and preferably not exceeding 0.5 mm.

It will be appreciated that the invention also includes modifications of and substitutions in the described embodiment in accordance with the general spirit and scope of the invention as set forth in the appended claims.

What is claimed is:

1. In a moving coil loudspeaker, the improvement comprising a cone made of a material comprised of a homopolymeric polypropylene incorporating from 20% to 40% by weight mineral filler, said cone material having a mechanical Q in the range 7 to 15, a Young's modulus in the range $28\times10^5$ to $57\times10^5$ KN/M$^2$, and density in the range of 1.05 to 1.45 gm/cc, a voice coil assembly including an apertured aluminum former carrying lapping paper at a joint with the cone, wherein the lapping paper is not overlapped in the direction of the periphery of the former, and wherein a minimal gap not exceeding 2 mm is left between adjacent ends of the lapping paper, said gap being slanted to the axis of the former and disposed on the opposite side from a gap between adjacent edges of the former material.

2. A speaker according to claim 1, wherein the mineral filler is talc.

3. A speaker according to claim 1, wherein the mineral filler is chalk.

4. A speaker according to claim 1, wherein the polypropylene also incorporates up to 5% carbon black filler.

5. A speaker according to claim 1, wherein the cone has a parabolic cross-section.

6. A speaker according to claim 1, wherein the centre of the cone is stiffened by a ring of high melting point hard plastics material.

7. A speaker as claimed in claim 6, wherein the said plastics material is nylon.

8. A speaker according to claim 1, including a dust dome of flexible material.

9. A speaker according to claim 8, wherein said flexible material is polyvinylchloride.

10. A speaker according to claim 1, wherein the cone material has a Young's modulus of about $32\times10^5$ KN/M$^2$, and a density of about 1.25 gm/cc.

* * * * *